US006863932B2

(12) United States Patent
Molnar et al.

(10) Patent No.: US 6,863,932 B2
(45) Date of Patent: Mar. 8, 2005

(54) METHOD OF MAKING AN ANTI-SLIP COATING AND AN ARTICLE HAVING AN ANTI-SLIP COATING

(75) Inventors: William S. Molnar, Bloomfield Hills, MI (US); Kevin J. Heinl, West Bloomfield, MI (US)

(73) Assignee: W. S. Molnar Company, Detroit, MI (US)

( * ) Notice: Subject to any disclaimer, the term of this patent is extended or adjusted under 35 U.S.C. 154(b) by 0 days.

(21) Appl. No.: 10/386,269

(22) Filed: Mar. 11, 2003

(65) Prior Publication Data

US 2003/0175440 A1 Sep. 18, 2003

Related U.S. Application Data

(60) Provisional application No. 60/363,678, filed on Mar. 12, 2002.

(51) Int. Cl.[7] ..... C23C 4/06
(52) U.S. Cl. ..... 427/456; 427/455
(58) Field of Search ..... 427/455, 456

(56) References Cited

U.S. PATENT DOCUMENTS

| | | | | | |
|---|---|---|---|---|---|
| 4,618,511 | A | * | 10/1986 | Molnar | 427/448 |
| 4,961,973 | A | | 10/1990 | Molnar | |
| 5,077,137 | A | * | 12/1991 | Molnar | 428/601 |
| 5,213,848 | A | * | 5/1993 | Zurecki et al. | 427/449 |
| 5,294,462 | A | * | 3/1994 | Kaiser et al. | 427/446 |
| 6,190,740 | B1 | * | 2/2001 | Rogers | 427/446 |

* cited by examiner

*Primary Examiner*—Katherine Bareford
(74) *Attorney, Agent, or Firm*—Brooks Kushman P.C.

(57) ABSTRACT

The present invention provides a method of coating a surface with a slip resistant coating. The method of the invention comprises either sequentially or simultaneously melting two different metal wires and directing droplets of the melted wires towards a surface to be coating. The resulting coating formed by this process tends to be rough and confers anti-slip properties to the surface. In one variation of the invention, the two different metal wires will be melted and atomized in a single spray gun. Alternatively, these wires may be melted in separate but adjacent spray guns. In either variation, the resulting metal sprays formed from the different wires will at least partially overlap.

21 Claims, 2 Drawing Sheets

METHOD OF MAKING AN ANTI-SLIP COATING AND AN ARTICLE HAVING AN ANTI-SLIP COATING

CROSS-REFERENCE TO RELATED APPLICATIONS

This application claims the benefit of U.S. Provisional Application Ser. No. 60/363,678, filed Mar. 12, 2002.

BACKGROUND OF THE INVENTION

1. Field of the Invention

A method of applying an anti-slip coating to a substrate such as a metal plate or metal grating and the article of manufacture made by the method.

2. Background Art

Anti-slip coatings are applied to a variety of substrates to improve slip resistance. An early form of anti-slip coating was formed by metalizing aluminum welding wire and directing the molten metal to a surface that has been partially covered by aluminum oxide grit. Another approach is to apply an epoxy and grit to a substrate. Both of these approaches suffer from the disadvantage of low durability because the grit, metalized aluminum, or epoxy binder can become dislodged or delaminate.

To solve the problems associated with the above anti-slip coatings, SlipNot® Safety Flooring was developed. SlipNot®, as originally developed, is formed by metalizing a cored wire and directing molten metal and alloying materials onto a surface to be coated. The cored wire has a hollow core that is filled with carbon and other materials such as aluminum as disclosed in applicant's prior U.S. Pat. Nos. 4,961,973 and 5,077,137. An example of the type of wire suitable for use in the SlipNot® process is wire type 1362 FC that is available from Cor-Met Inc. The high carbon content of the core results in the formation of martinsitic deposits of high hardness that resist wear. The desired hardness of the surface is between 40 and 65 Rockwell on the C scale (Rc). Generally, SlipNot® Safety Flooring has a hardness of between 55 and 65 Rc. One disadvantage of the SlipNot® process is the cost of the wire used to form the coating.

There is a need for a more economical, durable anti-slip coating process and for articles coated by the process that have high surface hardness and excellent adhesion to the substrate.

SUMMARY OF THE INVENTION

According to the process of the present invention, two different types of wire are sequentially or simultaneously metalized to coat the surface of a workpiece. For example, one wire is of the cored type while the other wire is a solid wire. The workpiece may be metal plate or grating and may be steel, aluminum, or another metal or alloy. In this embodiment, the present invention provides a method for forming an adherent rough coating on a receiving surface of an article. The coating formed by the method of the invention provides a slip resistant surface for persons walking or working on the surface, or for road or highway applications upon which vehicles move.

The method of the present invention comprises melting a first metallic wire electrode to form a first group of metallic droplets and melting a second metallic wire electrode to form a second group of metallic droplets. A first metallic spray is formed from the first group of metallic droplets and a second metallic spray is formed from the second group of metallic droplets. The first metallic spray and the second metallic spray are directed onto the receiving surface of the article. Finally, the first and second metallic sprays are commingled to form an adherent rough coating defining a slip resistant surface. The first metallic spray and the second metallic spray at least partially overlap as each spray is directed onto the receiving surface.

The article coated by the method of the present invention will typically be made from metal such as aluminum, steel or a metal alloy. The coating formed by the method of the present invention will preferably have a hardness of between about 40 Rc to about 65 Rc and cover from about 30% to about 100% of the area of the receiving surface. The adherent rough coating formed by the method of the invention will have a depth of at least about 0.010 inches.

According to another aspect of the process, each welding gun used in the coating process may be simultaneously supplied with one of each of the two different types of wire. It is anticipated that molten metal from both wires may commingle. If, for example, a cored wire and a solid wire are used some of the excess carbon from the cored wire may form martinsitic deposits in metal obtained from the solid wire. Alternatively, the first metallic wire electrode and the second metallic wire electrode used in the method set forth above may each independently be a hollow cored wire having carbon and alloying constituents that melt to form high carbon or martinsitic deposits. Such hollow cored wires will typically further include including grit particles as filler material in an amount from about 25% to about 50% by volume of the total amount of fill materials and a metal such as aluminum and iron. In the typical application of the present invention, the steps of forming a first metallic spray from the first group of metallic droplets and forming a second metallic spray from the second group of metallic droplets are performed essentially simultaneously in a single spray head. In one embodiment of the present invention, the first metal wire electrode is a solid wire and the second metal wire is a cored wire. Suitable metals from which the first and second metal wire electrodes may be made include steel, stainless steel, aluminum, and copper.

Alternatively, two adjacent guns that have an overlapping spray pattern may be provided with two different types of wire. If problems are encountered with the use of two different wires in a single welding gun, the use of adjacent guns each having one of two different wires could be used to apply two different types of coatings in overlapping spray patterns.

An alternative method of this variation comprises melting a first metallic wire electrode to form a first group of metallic droplets and forming a first metallic spray from the first group of metallic droplets. The first metallic spray is directed onto the receiving surface of the article to form a first coating on the substrate. A second metallic wire electrode is melted to form a second group of metallic droplets that form a second metallic spray. The second metallic spray is directed onto the first coating to form adherent multi-layered rough coating defining a slip resistant surface. In this embodiment, selection of the appropriate wire electrodes and other spraying conditions will be the same as set forth above.

According to a further alternative, a first set of welding guns may initially apply a first coating layer using one type of wire with a second set of welding guns being used to apply a second coating layer using another type of wire. If this latter alternative is used, a wire yielding a harder deposit would most likely be the second wire so that the outer portion of the coating is the hardest while the first wire provides surface roughness build-up and excellent adhesion properties.

These and other alternatives and combinations are possible to obtain additional processing flexibility and savings. The advantages described above may be obtained in the finished products without materially affecting the durability and quality of the final coating product.

DETAILED DESCRIPTION OF THE PREFERRED EMBODIMENT(S)

Figure 1:
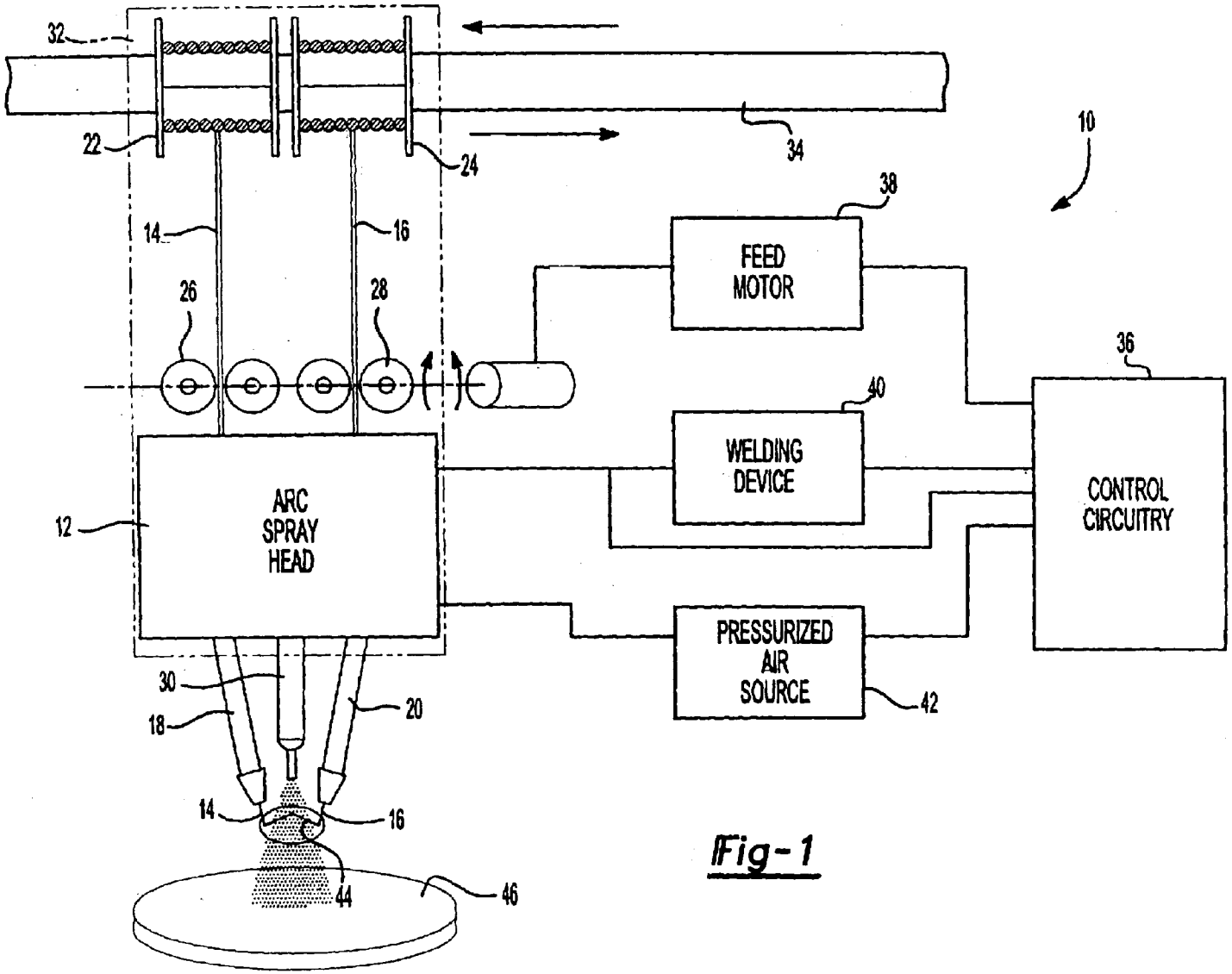
FIG. 1 is a schematic drawing of a welding gun head and related equipment used in the process of the present invention.
Figure 2:
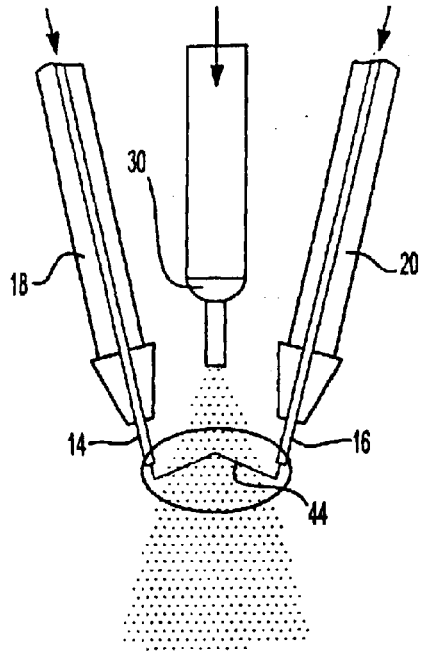
FIG. 2 is a fragmentary schematic front elevation view of a welding gun that may be used in the process of the present invention.

Referring now to FIGS. 1 and 2, a coating machine 10 including an arc spray head 12 that is suitable for use in the present invention is illustrated. First and second wire electrodes 14 and 16 are fed through first and second wire guide sleeves 18 and 20. First and second wire electrodes 14 and 16 are unreeled from first and second wire spools 22 and 24 at a controlled feed rate determined by first and second sets of feed rollers 26 and 28, respectively. A nozzle 30 directs a stream of pressurized air or other gas toward the tips of the first and second wire electrodes 14 and 16.

The arc spray head 12 is supported by a carriage 32 that is movable along a track 34 in a reciprocating motion. An object to be coated may be evenly coated as the spray head 12 moves back and forth while the object passes below the spray head 12, preferably on a power conveyor.

The coating machine includes a controller 36 for controlling operation of the arc spray head and associated power conveyors and drives used to move the arc spray head and articles. The controller 36 also controls a feed motor 38 that controls the rate of advancement of the first and second wire electrodes 14 and 16. The feed motor 38 may be a single feed motor or two feed motors. Two feed motors 38 may be necessary if the rate of advancement of the first and second wire electrodes 14 and 16 must be varied relative to each other. A welder 40 provides current through the arc spray head 12 to the first and second wire electrodes 14 and 16. Current is preferably provided through the first and second feed wire sleeves 18 and 20. An air compressor 42 provides air to the air nozzle 30 that is directed toward the ends of the first and second wire electrodes 14 and 16 and is also controlled by the controller 36. The welder 40 causes an electric arc 44 to be formed between the first and second wire electrodes 14 and 16. The electric arc 44 melts the first and second wire electrodes resulting in a stream of molten metal being directed toward a plate 46 by the air flow through the nozzle 30. The plate 46 is abraded by a shot peening machine such as a Wheelabrator® that cleans the surface and provides a limited degree of surface roughness.

First and second wire electrodes 14 and 16, according to one aspect of the invention, may be different types of wires. One of the wires is preferably a hollow cored wire having carbon and alloying constituents that melt to form high carbon or martinsitic deposits on the plate 46. An example of an appropriate cored wire is available from Cor-Met Inc. and is identified as wire type 1362 FC. The other wire may be a common steel wire having relatively low carbon content. An example of a suitable carbon steel wire is Lincolnweld™ L-61 commercially available form Lincoln Electric.

In another preferred variation, the first wire electrode is aluminum and the second wire electrode is copper. In this variation a coating comprising a mixture of copper and aluminum is formed. Such a coating is harder than compositions that include only aluminum. Suitable aluminum wires are made from, for example, aluminum alloys 5356, 1100, 1350, 1188, 1199, 5554, 5556, and 5654 which are commercially available from Alcotec Wire Corporation located in Traverse City, Mich. A suitable copper wire is TAFA OSTA copper wire (710143) commercially available from TAFA Incorporated located in Concord, N.H.

According to another aspect of the invention, an anti-slip coating may be formed by applying a first arc spray layer using two low carbon wires in a first pass over the plate 46 that is followed by a second pass with an arc spray head 12 that is provided with at least one or preferably two hollow cored wires of the type previously described.

Figure 3:
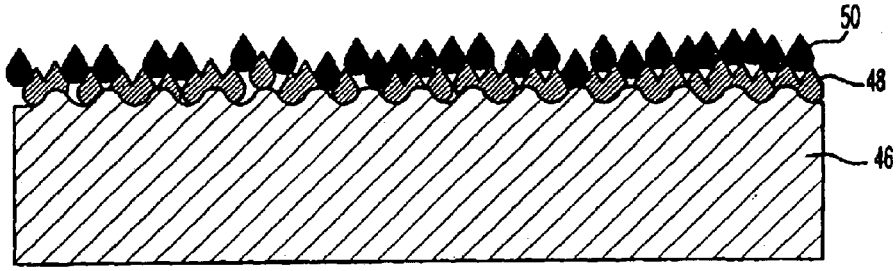
FIG. 3 is a schematic theoretic representation of a cross section of a steel plate made with a first set of welding guns that initially apply a first coating layer using one type of wire that is followed with a second set of welding guns that are used to apply a second coating layer using another type of wire.

Referring to FIG. 3, a plate having an anti-slip coating formed by the latter process is shown. The plate 46 has an initial layer of low hardness deposits identified by reference numeral 48 and shown in cross hatch in FIG. 3. The initial layer is formed by random deposits of arc spray from low carbon wire. After the layer having low hardness deposits 48 is applied, the plate is coated in a second step with a layer of high hardness deposits 50 shown as more closely cross hatched particles indicating a high martinsitic content or high carbon content resulting in a high hardness rough surface coating formed on the plate 46. This embodiment of the invention may provide a high profile rough surface because two layers are applied with the first layer of low carbon low hardness deposits 48 providing good adhesion between the high hardness deposits 50 and the plate 46.

Figure 4:
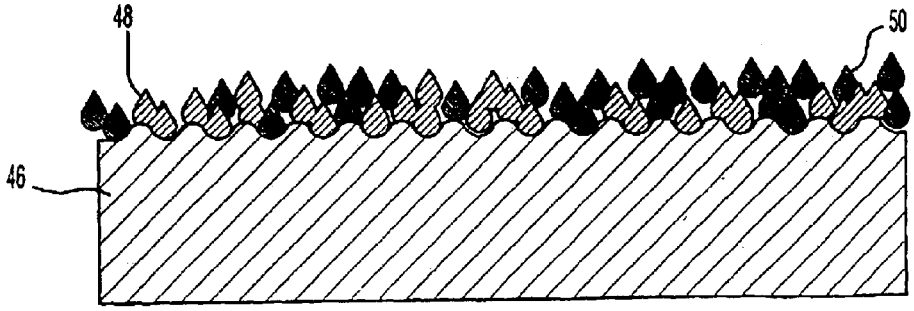
FIG. 4 is a schematic theoretic representation of a cross section of a steel plate made with a welding gun having two different wires that are simultaneously supplied with one of each of the two different types of wire.

Referring now to FIG. 4, an alternative embodiment of the invention is shown wherein an arc spray head is provided with a cored wire and a common steel wire each comprising one of the first and second wire electrodes 14 and 16. In this embodiment, it is expected that the feed rate of the two wires may require adjustment relative to each other to establish the appropriate proportions of low and high hardness deposits 48 and 50 on the finished plate 46. The wires 14 and 16 melt resulting in the application of low hardness deposits 48 shown in cross hatching in FIG. 4 and high hardness deposits 50 shown in more closely cross hatching in FIG. 4 being deposited in a random intermixed layer so that high hardness deposits 50 are adjacent to low hardness deposits 48. In use, it is expected that the high hardness deposits 50 may protect and prevent wear of the low hardness deposits 48. It is also expected that in the molten state, some of the excess carbon contained in the cored wire may increase the carbon content of the molten droplets from the common steel wire resulting in increased hardness of the low hardness deposits 48.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for forming an adherent rough coating on a receiving surface of an article to provide a slip resistant surface, the method comprising:

providing a first metallic wire electrode and a second metallic wire electrode wherein the first metallic wire electrode has a different composition than the second metallic wire electrode;

melting the first metallic wire electrode to form a first group of metallic droplets;

melting the second metallic wire electrode to form a second group of metallic droplets;

forming a first metallic spray from the first group of metallic droplets;

forming a second metallic spray from the second group of metallic droplets;

directing the first metallic spray and the second metallic spray onto the receiving surface of the article with pressurized air; and commingling the first and second metallic sprays to form an adherent rough coating defining a slip resistant surface.

2. The method of claim 1 wherein the slip resistant surface of has a hardness of between about 40 Rc to about 65 Rc.

3. The method of claim 1 wherein the first metallic wire electrode is a hollow cored wire having alloying constituents that melt to form a coating with a hard surface.

4. The process of claim 3 with said hollow cored wire includes fill materials further including grit particles.

5. The process of claim 4 wherein the grit particles are present in an amount from about 25% to about 50% by volume of the total amount of fill materials.

6. The method of claim 3 wherein the fill materials further include a metal selected from the group consisting of aluminum and iron.

7. The method of claim 1 wherein the steps of forming a first metallic spray from the first group of metallic droplets and forming a second metallic spray from the second group of metallic droplets are performed essentially simultaneously in a single spray head.

8. The method of claim 7 wherein the first group of metallic droplets and the second group of metallic droplets are directed towards the workpiece by the flow of a gas emerging from a nozzle in the spray head.

9. The process of claim 1 wherein the adherent rough coating covers from about 30% to about 100% of the area of the receiving surface.

10. The process of claim 1 wherein the an adherent rough coating is formed to a depth of at least about 0.010 inches.

11. The method of claim 1 wherein the first metal wire electrode is a solid wire and the second metal wire is a cored wire.

12. The method of claim 1 wherein the first metal wire electrode is aluminum wire.

13. The method of claim 1 wherein the first metal wire electrode is aluminum wire and the second metal wire electrode is copper wire.

14. The method of claim 1 wherein the article is metal or a metal alloy.

15. The method of claim 1 wherein the article is steel, stainless steel, or aluminum.

16. The method of claim 1 wherein the first and second wire electrodes are melted in the same spray gun.

17. The method of claim 1 wherein the first and second wire electrodes are melted in adjacent spray guns.

18. The method of claim 1 wherein the first metal wire electrode and the second metal wire electrode are fed into an arc spray guy at an appropriate relative feed rate so that a predetermined coating composition is formed.

19. A method for forming an adherent rough coating on a receiving surface of an article to provide a slip resistant surface for persons walking or working thereon, the method comprising:

providing a first metallic wire electrode and a second metallic wire electrode wherein the first metallic wire electrode has a different composition than the second metallic wire electrode;

melting the first metallic wire electrode to form a first group of metallic droplets;

forming a first metallic spray from the first group of metallic droplets;

directing the first metallic spray onto the receiving surface of the article to form a first coating on the article, the first coating including a first set of deposits;

melting the second metallic wire electrode to form a second group of metallic droplets;

forming a second metallic spray from the second group of metallic droplets; and directing the second metallic spray onto the first coating to form an adherent multi-layered rough coating defining a slip resistant surface for persons walking or working thereon, the adherent multi-layered rough coating having a second set of deposits having a higher level of hardness than the first set of deposits;

wherein a portion of the second set of deposits of the adherent multi-layered rough coating adheres to the receiving surface where voids are present in the first coating.

20. The method of claim 19 wherein the first metal wire electrode is a solid wire and the second metal wire is a cored wire.

21. The method of claim 19 wherein the first metallic wire electrode is melted and formed into a spray in a first spray gun and the second metallic wire electrode is melted and formed into a spray in a second spray gun.

* * * * *

UNITED STATES PATENT AND TRADEMARK OFFICE

CERTIFICATE OF CORRECTION

PATENT NO. : 6,863,932 B2
DATED : March 8, 2005
INVENTOR(S) : William S. Molnar and Kevin J. Heinl It is certified that error appears in the above-identified patent and that said Letters Patent is hereby corrected as shown below:

Column 5,
Line 29, delete “of” (first occurrence)
Line 48, delete “workpiece” and insert -- receiving surface --.
Line 54, delete “an”
Lines 55 and 56, delete “metal” and insert -- metallic --.

Column 6,
Lines 1, 3, 4, 14, 15, 47 and 48, delete “metal” and insert -- metallic --.
Line 17, delete “guy” and insert -- gun --.

Signed and Sealed this

Twenty-fourth Day of May, 2005

JON W. DUDAS
*Director of the United States Patent and Trademark Office*